US005926149A

United States Patent [19]

Rümmeli et al.

[11] Patent Number: 5,926,149

[45] Date of Patent: Jul. 20, 1999

[54] COAXIAL ANTENNA

[75] Inventors: Bernd Rümmeli, Strande; Olaf Mann, Starnberg, both of Germany

[73] Assignee: RR Elektronische Gerate GmbH & Co. KG, Kiel, Germany

[21] Appl. No.: 08/936,138

[22] Filed: Sep. 24, 1997

Related U.S. Application Data

[63] Continuation of application No. 08/328,663, Oct. 25, 1994, abandoned.

[30] Foreign Application Priority Data

Oct. 27, 1993 [DE] Germany ..... 43 36 633

[51] Int. Cl.[6] ..... H01Q 9/22

[52] U.S. Cl. ..... 343/791; 343/749

[58] Field of Search ..... 343/715, 790–793, 343/722, 729, 749, 730, 900; H01Q 1/10, 1/32, 9/22, 9/38

[56] References Cited

U.S. PATENT DOCUMENTS

| | | | |
|---|---|---|---|
| 4,442,438 | 4/1984 | Siwiak et al. | 343/792 |
| 4,494,122 | 1/1985 | Garay et al. | 343/792 |
| 4,675,687 | 6/1987 | Elliott | 343/722 |
| 4,730,195 | 3/1988 | Phillips et al. | 343/792 |
| 5,089,829 | 2/1992 | Haruyama et al. | 343/792 |

*Primary Examiner*—Michael C. Wimer
*Attorney, Agent, or Firm*—Henry M. Feiereisen

[57] ABSTRACT

A coaxial antenna includes a vertical half-wave dipole with a lower section in form of a sleeve and an upper section in form of a first conductor bar, with the sleeve being dimensioned so as to resonate at a first frequency or first frequency range. A second conductor bar is operatively connected to the free end of the first conductor bar to define an assembly of first and second conductor bars which is dimensioned so as to resonate at a second frequency or second frequency range.

23 Claims, 2 Drawing Sheets

COAXIAL ANTENNA

This is a continuation of application Ser. No. 08/328,663, filed Oct. 25, 1994 as abandoned.

BACKGROUND OF THE INVENTION

The present invention refers to a coaxial antenna, and in particular to a coaxial antenna with a vertical half-wave dipole having a lower section formed as sleeve and an upper section formed as radiating element, with the sleeve and the radiating element cooperating to resonate at a first frequency or first frequency range, wherein the radiating element is constructed as to form a second half-wave dipole resonating at a second higher frequency or frequency range.

U.S. Pat. No. 2,184,729 and the publication "Antennenbuch", Karl Rothammel, 8th edition, Stuttgart, Telekosmos-Verlag, chapter 25.1.1. "Die Koaxialantenne", disclose a coaxial antenna which is utilized as vertically polarized omnidirectional antenna in the very high frequency range for mobile stations. In a 60-Ω-coaxial cable with thick inner conductor, the outer sheath, outer conductor and dielectric are withdrawn over a length of electrically $\lambda/4$ (about $\lambda/4\times0.97$) for exposing the bare inner conductor. Placed over the coaxial cable is a copper pipe or brass pipe which is also a quarter wavelength long and soldered to the outer conductor of the cable on the end facing the inner cable conductor. The pipe may be of any diameter so long as the clear width allows a placement of the pipe over the outer sheath of the cable. A coaxial antenna of this type constitutes basically a vertical half-wave dipole, with the lower $\lambda/4$ section simultaneously forming a quarter-wave sleeve for creating the symmetry.

This conventional coaxial antenna is suitable for transmission and reception of only a single frequency or frequency range, with a ratio equaling an integral multiple.

Further conventional multiple frequency antennas are known which are formed by two vertically superposing half-wave dipoles, with the feeding point being arranged between these half-wave dipoles. Such a multiple frequency antenna must be mounted via a mast which extends parallel to the superimposed half-wave dipoles and includes a jib which extends transversely to the mast for attachment of the multiple frequency antenna. Since such an assembly has a great demand for space, it is not suitable for mobile stations. Moreover, a substantial impairment is encountered because the coaxial cable, which is connected to the antenna, extends parallel to the antenna axis along the mast.

SUMMARY OF THE INVENTION

It is an object of the present invention to provide an improved coaxial antenna obviating the afore-stated drawbacks.

It is another object of the present invention to provide an improved coaxial antenna which has dimensions suitable for mobile stations and can be operated over a wide range of frequencies, e.g. when utilizing the antenna for operating maritime radio services or for mobile telephones.

These objects and others which will become apparent hereinafter, are attained in accordance with the present invention by constructing the radiating element in the form of two conductor bars preferably connected by a phasing line and dimensioned such as to cooperatively form a half-wave dipole resonating in the higher of the two frequency ranges.

The invention is thus based on the teaching to modify a conventional coaxial antenna having a vertical half-wave dipole comprised of a lower section formed as sleeve and an upper section formed as a first conductor bar, by adding an assembly of phasing line and second conductor bar on top of the first conductor bar.

According to a preferred embodiment of the present invention, the axial length of the sleeve is about ¼ or ¾ of the wavelength which equals a frequency in the range of 156 to 163 MHz, constituting the very high frequency maritime mobile service. The axial length of the first conductor bar equals about ⅛ or ⅝ of the wavelength which corresponds to a frequency in the range of 890 to 960 MHz, constituting the frequency range for mobile telephones. The axial length of the second conductor bar equals about ⅛ or ⅝ of the wavelength which corresponds with the frequency in the range of 890 to 960 MHz.

The provision of a coaxial antenna according to the present invention enables a transmission and reception of widely different frequencies which do not equal integral multiples of each other, while attaining a high antenna gain. In a coaxial antenna according to the present invention, the assembly comprised of a first conductor bar, phasing line and second conductor bar essentially resonates at a frequency in the range of 890 to 960 MHz. The lower sleeve section of the half-wave dipole in conjunction with the radiating element of the coaxial antenna according to the invention resonates at a frequency in the range of about 156 to 163 MHz.

Persons skilled in the art will understand that the teaching according to the invention is also applicable for frequencies other than the described frequency ranges. Also, other length dimensions should be considered within the scope of the invention so long as they resonate at the various frequencies. The axial length of the lower section of the half-wave dipole and/or of the first conductor bar and/or of the second conductor bar may be dimensioned ⅛ or an integral multiple of the respective wavelength or frequency.

According to a further preferred embodiment of the present invention, the lower section of the half-wave dipole is formed by an electrically conducting tube, which may be made of copper or brass, and is electrically connected at its end facing the first conductor bar with the outer conductor of a coaxial cable which is routed through the tube. The inner conductor of the coaxial cable is connected to the first conductor bar at the end facing the sleeve.

In accordance with another feature of the present invention, the upper end of the sleeve is provided with a dielectric which is traversed by the first conductor bar. Preferably, the dielectric between the first conductor bar and the sleeve is formed, at least partially, as a printed circuit board for connecting the outer conductor of the coaxial cable with the sleeve and the inner conductor of the coaxial cable with the first conductor bar.

According to another embodiment of the present invention, an impedance matching network is arranged on the printed circuit board. Suitably, the printed circuit board is further equipped with a coaxial connector, e.g. BNC-connector or N-standard, or a corresponding plug in order to allow attachment of the coaxial cable in a simple manner to the antenna according to the invention. The impedance matching network is formed as coils and/or capacitors upon the printed circuit board.

Preferably, the coaxial antenna is adjusted by suitably modifying the ratio between the inner diameter of the sleeve and the outer diameter of the coaxial cable that is directed through the sleeve. Since it cannot always be excluded that the lower section and the upper section of the half-wave dipole affect the resonant frequency of the respective sections, it is further provided in accordance with another feature of the present invention to extend or to shorten the sleeve and/or the first conductor bar and/or the second conductor bar by a matching factor in order to adjust the lower and upper sections of the half-wave dipole to the varying frequencies.

Preferably, the phasing line between the first and second conductor bars is designed in form of a coil.

In accordance with another embodiment of the present invention, further assemblies of conductor bar and phasing line are added onto the first conductor bar of the coaxial antenna according to the invention.

Suitably, the sleeve and/or the first and second conductor bars are formed respectively by a coiled conductor to create an antenna according to the present invention of particularly small dimensions.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
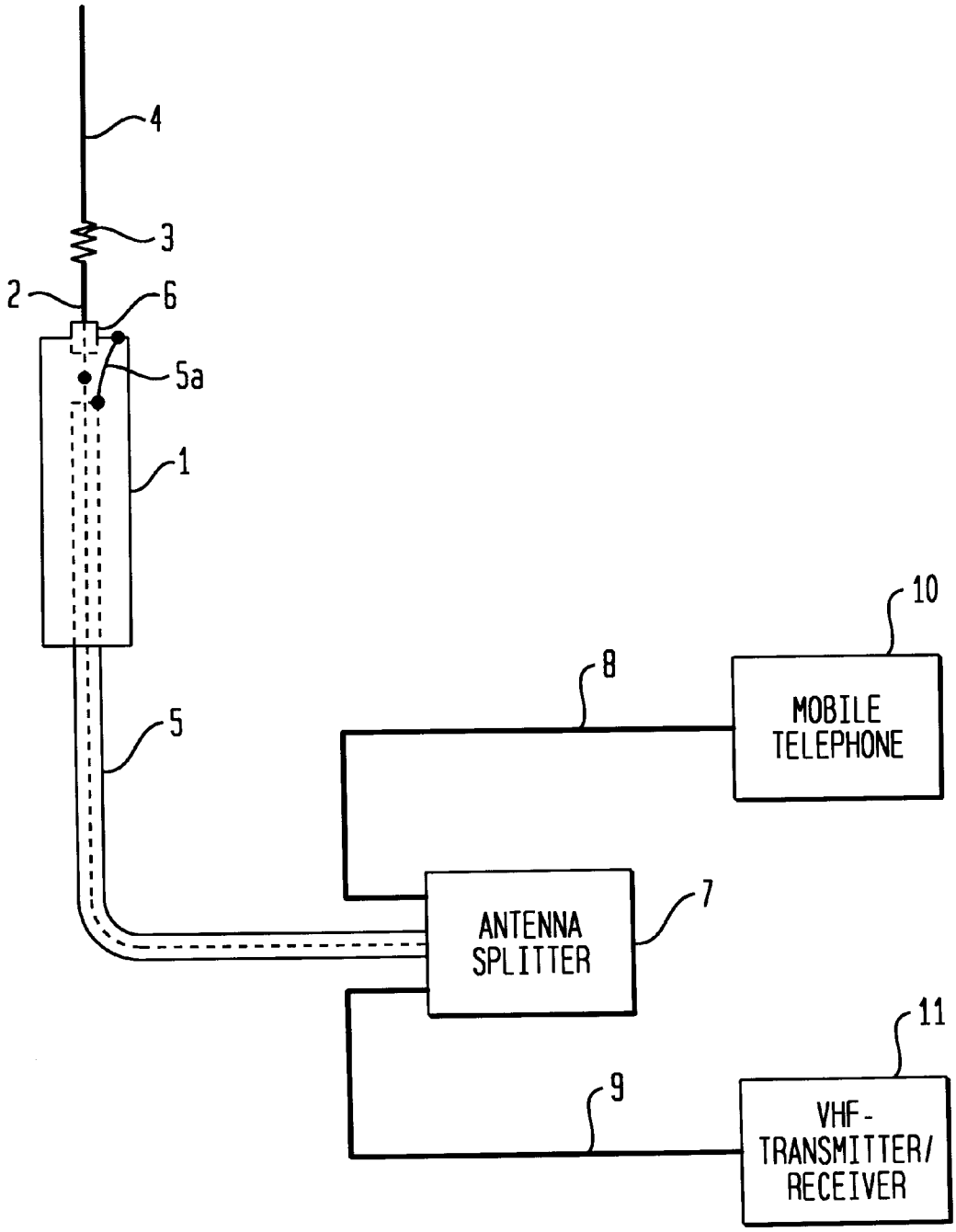
FIG. 1 shows a schematic illustration of one embodiment of a coaxial antenna according to the invention.

Referring now to the sole FIG. 1, there is shown a schematic illustration of a coaxial antenna according to the present invention, including a vertical half-wave dipole with a lower section in form of a tubular sleeve 1 and an upper section having a first conductor bar 2, a phasing line 3 in form of a coil which is connected to the conductor bar 2, and a second conductor bar 4 connected to the phasing line 3. A coaxial cable 5 is guided axially inside the sleeve 1 and extends beyond the sleeve 1 for connection to an antenna splitter 7. A transmission line 8 links the antenna splitter 7 to a mobile telephone 10, e.g. a digital radiotelephone network at frequencies in the range of 890 to 960 MHz, while a coaxial line 9 connects the antenna splitter 7 with a VHF transmitterlreceiver 11 for the VHF maritime frequency band in the range of 156 to 163 MHz.

The sleeve 1, forming the lower section of the half-wave dipole, is provided in form of an electrically conducting tube made of copper, brass or any other suitable conductive material. On its upper end, the sleeve 1 carries a dielectric 6 which is traversed by the first conductor bar 2, with the coiled phasing line 3 and the second conductor bar 4 being secured on top of the first conductor bar 2. The assembly of first conductor bar 2, second conductor bar 4 and interposed phasing line 3 is electrically connected together. The dielectric 6 insulates the first conductor bar 2, which traverses the dielectric 6 and projects into the sleeve 1, from the conducting sleeve 1. The dielectric 6 also ensures a secure attachment of the assembly comprised of the first conductor bar 2, phasing line 3 and second conductor bar 4 in relationship to the sleeve 1.

Figure 2:
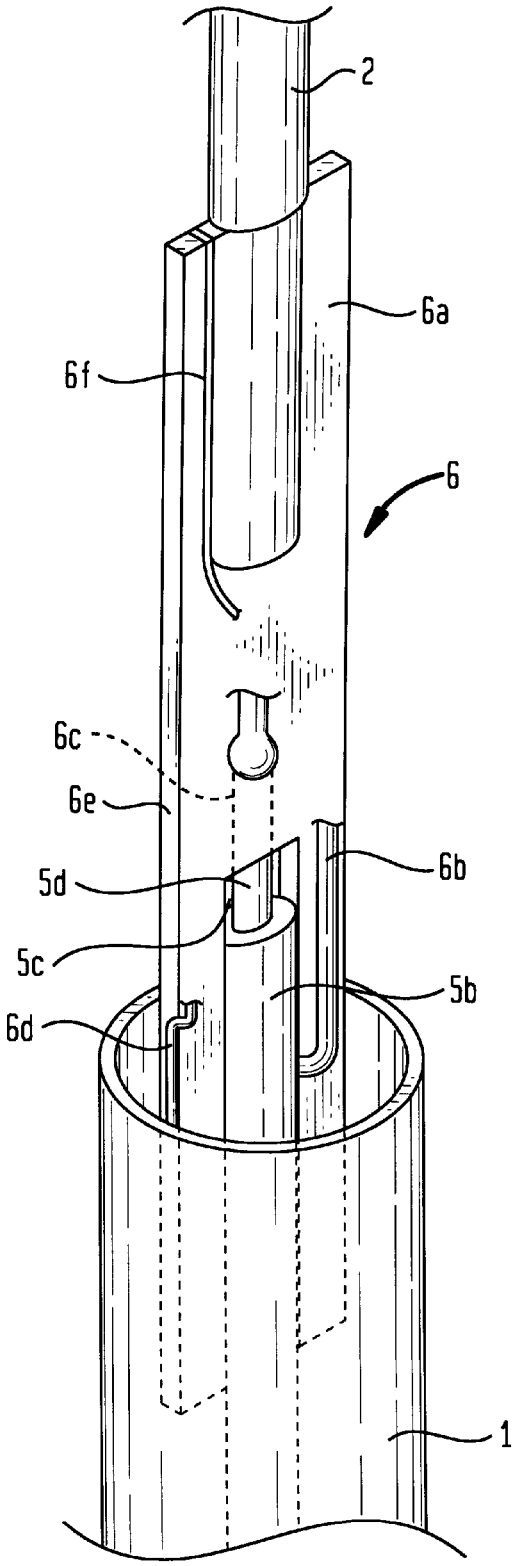
FIG. 2 shows a detailed illustration of an exemplified coaxial antenna according to the present invention.

Turning now to FIG. 2, there is shown a detailed illustration of the coaxial antenna of FIG. 1, with the dielectric 6 between the first conductor bar 2 and the sleeve 1 being formed as a printed circuit board 6*a*. The coaxial cable 5 has an outer conductor 5*b* which is received in a cutout 5*c* of the p.c. board 6*a* and soldered to a circuit track 6*b* that is guided to the cutout 5*c*. The inner conductor 5*d* of the coaxial cable 5 is received in a bore 6*c* of the p.c. board 6*a* and also soldered thereto. The p.c. board 6*a* with the coaxial cable 5 is connected via a circuit track 6*d*, that is routed on the outside 6*e* of the p.c. board 6*a*, to the sleeve 1. Thus, the p.c. board 6*a* is made electrically conductive and mechanically secured to the sleeve 1. The circuit tracks 6*a*, 6*d* are connected to one another to effect the electric connection. The conductor bar 2 is received in a bore of the p.c. board 6*a* and soldered to a circuit track 6*f* that is routed to the upper edge of the p.c. board 6*a*.

The coaxial antenna according to the present invention can be made in a simple manner by pushing the coaxial cable 5 into the sleeve 1 which is made in form of a conducting tube. The inner conductor of the coaxial cable 5 is electrically connected with the end of the first conductor bar 2 projecting into the sleeve 1 while the outer conductor of the coaxial cable 5 is connected in the area of the upper end of the sleeve 1 facing the first conductor bar 2 with the sleeve 1, as indicated by 5*a*.

The axial length of the sleeve 1 is about $\lambda/4$ of the wavelength corresponding to the VHF-maritime radio frequency band of 156 to 163 MHz. The first conductor bar 2 corresponds to about ¼ of the wavelength which equals the frequency band for the digital radiotelephone network of 890 to 960 MHz. The second conductor bar 4, which is set onto the first conductor bar 2 via the coiled phasing line 3, has an axial length which corresponds to ⅝ of the wavelength of the digital radiotelephone network. The assembly of first conductor bar 2, phasing line 3 and second conductor bar 4 resonates at the VHF-maritime radio frequency range.

Practice has shown that the lower section in form of the sleeve 1 and the upper section in form of the first conductor bar 2, phasing line 3 and second conductor bar 4, of the vertical half-wave dipole mutually affect each other according to the invention in their resonance characteristics. In order to improve the resonance of the respective sections and thus the antenna gain, the sleeve 1 and/or the first conductor bar 2 and/or the second conductor bar 4 are extended or shortened by a matching factor.

Suitably, the coaxial antenna according to the present invention is adjusted through suitable modification of the ratio of inner diameter of the sleeve 1 relative to the outer diameter of the coaxial cable 5 which is guided through the sleeve 1.

The upper end of the vertical sleeve 1 is suitably configured to prevent a penetration of rain or splashing water. The lower end of the otherwise hermetically sealed sleeve 1 includes a bore for passage of the coaxial cable 5 and an opening (not shown) for condensation water. Persons skilled in the art will understand that the bore for the cable may also be substituted by a BNC-connector or BNC-plug or by a N-connector or N-plug for attachment of the coaxial cable 5 to the coaxial antenna according to the present invention.

While the invention has been illustrated and described as embodied in a coaxial antenna, it is not intended to be limited to the details shown since various modifications and structural changes may be made without departing in any way from the spirit of the present invention. What is claimed as new and desired to be protected by letters patent is set forth in the appended claims:

We claim:

1. A coaxial antenna for transmitting and receiving signals in two frequency ranges, each frequency range having a center frequency, with the center frequencies spaced apart by at least the lower of the two center frequencies, said device comprising:

a first dipole element having a first section in form of a sleeve and a second section in form of a radiating element, with said sleeve and said radiating element being dimensioned and connected with each other in series so as to cooperatively form a half-wave dipole resonating in the lower of said two frequency ranges, said radiating element comprising at least two conductor bars separated by at least one phasing line connecting the conductor bars, wherein said conductor bars and said phasing line are dimensioned such as to cooperatively form a half-wave dipole resonating at the higher of said two frequency ranges.

2. The antenna of claim 1 wherein said sleeve is a tube made of a material selected from the group consisting of copper and brass, further comprising a coaxial cable having inner and outer conductors and extending through said tube, said outer conductor being electrically connected to said tube at an end facing said radiating element.

3. The antenna defined in claim 2 wherein said coaxial cable has an inner conductor which is electrically connected to said radiating element at one end facing said sleeve.

4. The antenna defined in claim 1 wherein said sleeve has an axial length of about ⅛, or an integral multiple thereof, of a first wavelength which corresponds to the lower center frequency or lower frequency range.

5. The antenna defined in claim 1 wherein a first one of the conductor bars has an axial length of about ⅛, or an integral multiple thereof, of a second wavelength which corresponds to the higher center frequency or higher frequency range.

6. The antenna defined in claim 1 wherein said phasing line is provided in form of a coil.

7. The antenna defined in claim 5 wherein a second one of the conductor bars has an axial length of about ⅛, or an integral multiple thereof, of the second wavelength.

8. The antenna defined in claim 1 wherein the lower frequency range is in the range of maritime radio frequencies of about 156 to 163 MHz.

9. The antenna defined in claim 1 wherein the higher frequency range is in the range of mobile radio frequencies of about 890 to 960 MHz, constituting the digital radiotelephone network.

10. The antenna defined in claim 1, further comprising a dielectric mechanically connecting said sleeve with said radiating element.

11. The antenna defined in claim 2, further comprising a dielectric formed by a printed circuit board and connecting the outer conductor of said coaxial cable with said sleeve, one the one hand, and the inner conductor of said coaxial cable with said radiating element, on the other hand.

12. The antenna as defined in claim 11, further comprising an impedance-matching network which is connected between at least one of the following pairs consisting of said radiating element and said inner conductor of said coaxial cable, and said outer conductor of said coaxial cable and said sleeve.

13. The antenna as defined in claim 12 wherein said impedance-matching network is arranged on said printed circuit board.

14. The antenna defined in claim 12 wherein said impedance-matching network is formed by at least one component selected from the group consisting of coil and capacitor.

15. The antenna defined in claim 2 wherein said sleeve has an inner diameter and said coaxial cable has an outer diameter, the antenna being adjusted through adjustment of the ratio of the inner diameter of said sleeve and the outer diameter of said coaxial cable which is guided through said sleeve.

16. The antenna defined in claim 1 wherein the axial length of said sleeve equals about ¼ or ¾ of the wavelength of the lower center frequency or lower frequency range.

17. The antenna defined in claim 5 wherein the axial length of said first conductor bar is about ¼ or ⅝ of the second wavelength.

18. The antenna defined in claim 7 wherein the axial length of said second conductor bar is about ⅝ of the second wavelength.

19. The antenna defined in claim 1 wherein said sleeve and said radiating element are each defined by a length, the lengths of said sleeve and said radiating element being extended or shortened by a matching factor for adjusting the lower and upper sections of said half-wave dipole to the lower of the two frequency ranges.

20. The antenna defined in claim 1, further comprising an additional conductor bar and an additional phasing line for connection to said first conductor bar.

21. The antenna defined in claim 1 wherein said sleeve is provided in form of a coiled conductor.

22. The antenna defined in claim 1 wherein a first one of the conductor bars is provided in form of a coiled conductor.

23. The antenna defined in claim 1 wherein a second one of the conductor bars is provided in form of a coiled conductor.

* * * * *